US007062932B2

(12) United States Patent
Downs

(10) Patent No.: US 7,062,932 B2
(45) Date of Patent: Jun. 20, 2006

(54) REFRIGERATED MERCHANDISER WITH FAN-POWERED REAR DISCHARGE

(75) Inventor: Norman L. Downs, St. Peters, MO (US)

(73) Assignee: Hussmann Corporation, Bridgeton, MO (US)

( * ) Notice: Subject to any disclaimer, the term of this patent is extended or adjusted under 35 U.S.C. 154(b) by 0 days.

(21) Appl. No.: 10/925,119

(22) Filed: Aug. 24, 2004

(65) Prior Publication Data

US 2006/0042288 A1 Mar. 2, 2006

(51) Int. Cl.
*A47F 3/04* (2006.01)

(52) U.S. Cl. ..... 62/255; 62/256; 454/193

(58) Field of Classification Search ..... 62/255, 62/256; 454/193
See application file for complete search history.

(56) References Cited

U.S. PATENT DOCUMENTS

| | | | | |
|---|---|---|---|---|
| 2,952,992 | A | 9/1960 | Voorhies | |
| 3,182,466 | A * | 5/1965 | Beckwith | 62/256 |
| 3,289,432 | A | 12/1966 | Brennan et al. | |
| 3,304,740 | A | 2/1967 | Dickson et al. | |
| 3,392,543 | A | 7/1968 | Miller | |
| 3,392,544 | A * | 7/1968 | Perez | 62/256 |
| 3,501,925 | A | 3/1970 | Brennan et al. | |
| 3,531,945 | A | 10/1970 | Brennan | |
| 3,648,482 | A | 3/1972 | Beckwith et al. | |
| 3,756,038 | A * | 9/1973 | MacMaster et al. | 62/256 |
| 3,771,323 | A | 11/1973 | Simons et al. | |
| 4,285,204 | A | 8/1981 | Vana | |
| 4,741,171 | A | 5/1988 | Toshiyuki | |
| 4,760,708 | A | 8/1988 | Karashima | |
| 5,502,979 | A * | 4/1996 | Renard | 62/256 |
| 5,675,983 | A * | 10/1997 | Ibrahim | 62/255 |
| 5,755,108 | A * | 5/1998 | Ibrahim et al. | 62/256 |
| 5,870,903 | A | 2/1999 | Meyers et al. | |
| 6,145,327 | A | 11/2000 | Navarro | |
| 6,539,741 | B1 | 4/2003 | Navarro | |
| 6,742,344 | B1 * | 6/2004 | Vormedal | 62/89 |
| 6,912,864 | B1 * | 7/2005 | Roche et al. | 62/256 |

FOREIGN PATENT DOCUMENTS

| | | |
|---|---|---|
| DE | 10205622 | 8/2003 |
| EP | 0600845 | 6/1994 |
| GB | 2231947 | 11/1990 |
| GB | 2247741 | 3/1992 |
| JP | 6123544 | 5/1994 |

* cited by examiner

*Primary Examiner*—William E. Tapolcai
(74) *Attorney, Agent, or Firm*—Michael Best & Friedrich LLP

(57) ABSTRACT

A refrigerated merchandiser includes a case defining a product display area and an air passage at least partially surrounding the product display area. The air passage directs refrigerated air to the product display area. The case also defines an air chamber separate from the air passage and in fluid communication between the air passage and the product display area. The merchandiser also includes a fan operable to draw the refrigerated air from the air passage and pressurize the refrigerated air within the air chamber to facilitate distribution of the refrigerated air from the air chamber and into the product display area.

27 Claims, 3 Drawing Sheets

REFRIGERATED MERCHANDISER WITH FAN-POWERED REAR DISCHARGE

FIELD OF THE INVENTION

This invention relates generally to refrigerated merchandisers, and more particularly to low-temperature refrigerated merchandisers.

BACKGROUND OF THE INVENTION

In conventional practice, supermarkets and convenience stores are equipped with refrigerated merchandisers, which may be open or provided with doors, for presenting fresh food or beverages to customers while maintaining the fresh food and beverages in a refrigerated environment. Typically, cold, moisture-bearing air is provided to a product display area of the merchandiser by passing an airflow over the heat exchange surface of an evaporator coil, or evaporator. A suitable refrigerant is passed through the evaporator, and as the refrigerant evaporates while passing through the evaporator, heat is absorbed from the air passing through the evaporator. As a result, the temperature of the air passing through the evaporator is lowered for introduction into the product display area of the merchandiser.

Such a prior-art refrigerated merchandiser 10 is shown in FIG. 1. The merchandiser 10 includes a case 14 generally defining an interior bottom wall 18, an interior rear wall 22, and an interior top wall 26. The area bounded by the interior bottom wall 18, interior rear wall 22, and the interior top wall 26 defines a product display area 30, in which the fresh food and/or beverages are stored on one or more shelves 32. The case 14 includes an open front face to allow customers access to the fresh food and/or beverages stored in the case 14.

The case 14 also generally defines an exterior bottom wall 34 adjacent the interior bottom wall 18, an exterior rear wall 38 adjacent the interior rear wall 22, and an exterior top wall 42 adjacent the interior top wall 26. A lower flue 46 is defined between the interior and exterior bottom walls 18, 34 to allow for substantially horizontal airflow throughout the lower flue 46. The interior bottom wall 18 includes an opening 50 to allow communication between the product display area 30 and the lower flue 46 allowing air from the product display area 30 to be drawn into the lower flue 46. A rear flue 54 is defined between the interior and exterior rear walls 22, 38 and is fluidly connected with and adjacent to the lower flue 46. The rear flue 54 allows for substantially vertical airflow throughout the rear flue 54. An upper flue 58 is defined between the interior and exterior top walls 26, 42 and is fluidly connected with and adjacent to the rear flue 54. The upper flue 58 allows for substantially horizontal airflow throughout the upper flue 58. The interior top wall 26 includes an opening 62 to allow communication between the product display area 30 and the upper flue 58 allowing airflow in the upper flue 58 to be discharged into the product display area 30. When combined, the lower flue 46, the rear flue 54, and the upper flue 58 comprise an air passage separate from the product display area 30.

The refrigerated merchandiser 10 also includes some components of a refrigeration system (not entirely shown) therein. One or more fans 66 are located within the lower flue 46 toward the back of the case 14 to generate an airflow through the lower, rear, and upper flues 46, 54, 58. An evaporator 70 is located within the rear flue 54 toward the bottom of the case 14. The evaporator 70 is positioned downstream of the fans 66 such that the airflow generated by the fans 66 is forced through the evaporator 70. The refrigeration system may also include other components (not shown), such as one or more compressors, one or more condensers, a receiver, and one or more expansion valves, all of which may be remotely located from the refrigerated merchandiser 10.

The evaporator 70 is configured to receive a liquid refrigerant from the receiver. As is known in the art, the liquid refrigerant is evaporated as it passes through the evaporator 70 as a result of absorbing heat from the airflow passing through the evaporator 70. Consequently, the temperature of the airflow passing through the evaporator 70 decreases as it passes through the evaporator 70. The heated, or gaseous refrigerant then exits the evaporator 70 and is pumped back to the compressor(s) for re-processing into the refrigeration system.

Downstream of the evaporator 70, the refrigerated airflow is routed vertically through the rear flue 54, and horizontally through the upper flue 58 before being discharged from the upper flue 58 via the opening 62 in the interior top wall 26. After being discharged from the opening 62 in the interior top wall 26, the refrigerated airflow moves downwardly along the open front face of the refrigerated merchandiser 10 before being drawn back into the opening 50 in the interior bottom wall 18 for re-use by the fans 66. This portion of the refrigerated airflow is known in the art as an air curtain 78.

SUMMARY OF THE INVENTION

The present invention provides, in one aspect, a refrigerated merchandiser including a case, defining a product display area and an air passage at least partially surrounding the product display area. The air passage includes a cooling passage that directs refrigerated air to the product display area. The case also defines an air chamber separate from the cooling passage and in fluid communication between the cooling passage and the product display area. The merchandiser also includes a fan operable to draw the refrigerated air from the cooling passage and pressurize the refrigerated air within the air chamber to facilitate distribution of the refrigerated air from the air chamber and into the product display area.

The present invention provides, in another aspect, a refrigerated merchandiser including a case, defining a product display area and a cooling passage at least partially defined in a rear portion of the case to direct refrigerated air to the product display area. The cooling passage is defined in part by a first wall having an aperture therein. The case also defines a second wall spaced from the first wall. The first and second walls define in part an air chamber in fluid communication with the product display area through a plurality of apertures in the second wall. The merchandiser also includes a fan operable to move the refrigerated air from the cooling passage and through the aperture in the first wall to pressurize the refrigerated air within the air chamber to facilitate distribution of the refrigerated air from the air chamber and into the product display area through the apertures in the second wall.

The present invention provides, in yet another aspect, a refrigerated merchandiser including a case defining a product display area and a cooling passage having a substantially vertical portion in a rear portion of the case separate from the product display area, an evaporator operable to refrigerate airflow passing through the evaporator and into the substantially vertical portion, a first fan operable to generate the airflow through the evaporator and into the substantially vertical portion, a second fan positioned downstream of the evaporator to draw the refrigerated airflow from the substantially vertical portion, and an air distribution chamber adjacent to and in fluid communication with the substantially vertical portion to receive the refrigerated airflow drawn from the substantially vertical portion by the second fan. The air distribution chamber includes a plurality of outlet openings fluidly communicating the air distribution chamber with the product display area to substantially distribute the refrigerated airflow to the product display area.

The present invention provides, in another aspect, a refrigerated merchandiser including a case defining a product display area, an air passage at least partially surrounding the product display area, and an air chamber separate from the air passage and in fluid communication with the product display area and a portion of the air passage containing refrigerated air. The refrigerated merchandiser also includes a fan operable to draw the refrigerated air from the portion of the air passage and pressurize the refrigerated air within the air chamber to facilitate distribution of the refrigerated air from the air chamber and into the product display area. In addition, the refrigerated merchandiser includes a controller electrically connected with the fan. The controller is operable to deactivate the fan during defrost mode of the merchandiser.

Other features and aspects of the present invention will become apparent to those skilled in the art upon review of the following detailed description, claims and drawings.

BRIEF DESCRIPTION OF THE DRAWINGS

In the drawings, wherein like reference numerals indicate like parts.

Figure 1:
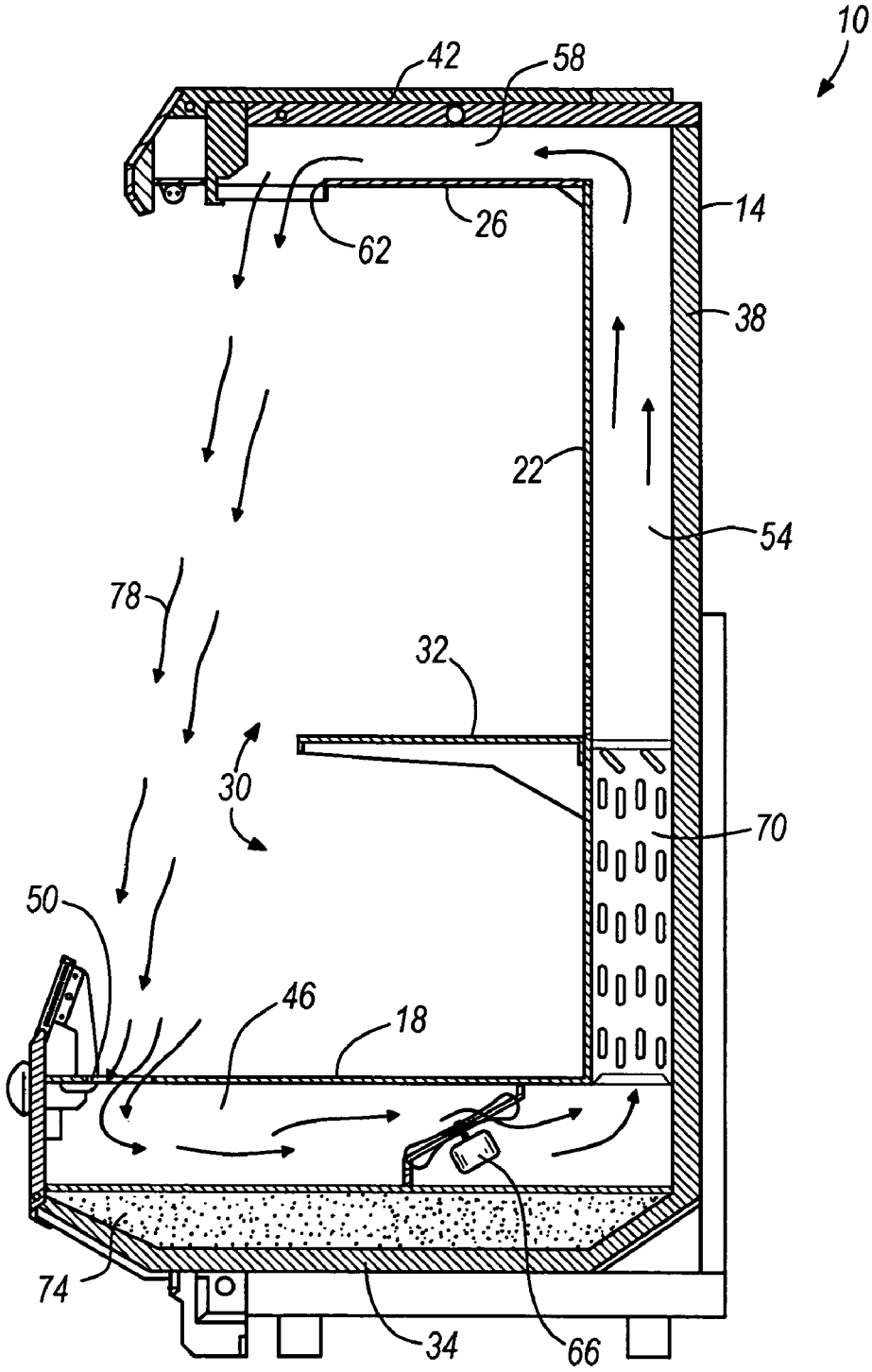
FIG. 1 PRIOR ART
FIG. 1 is a cross-sectional view of a prior-art refrigerated merchandiser.

Before any features of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of letters to identify elements of a method or process is simply for identification and is not meant to indicate that the elements should be performed in a particular order.

DETAILED DESCRIPTION

Figure 2:
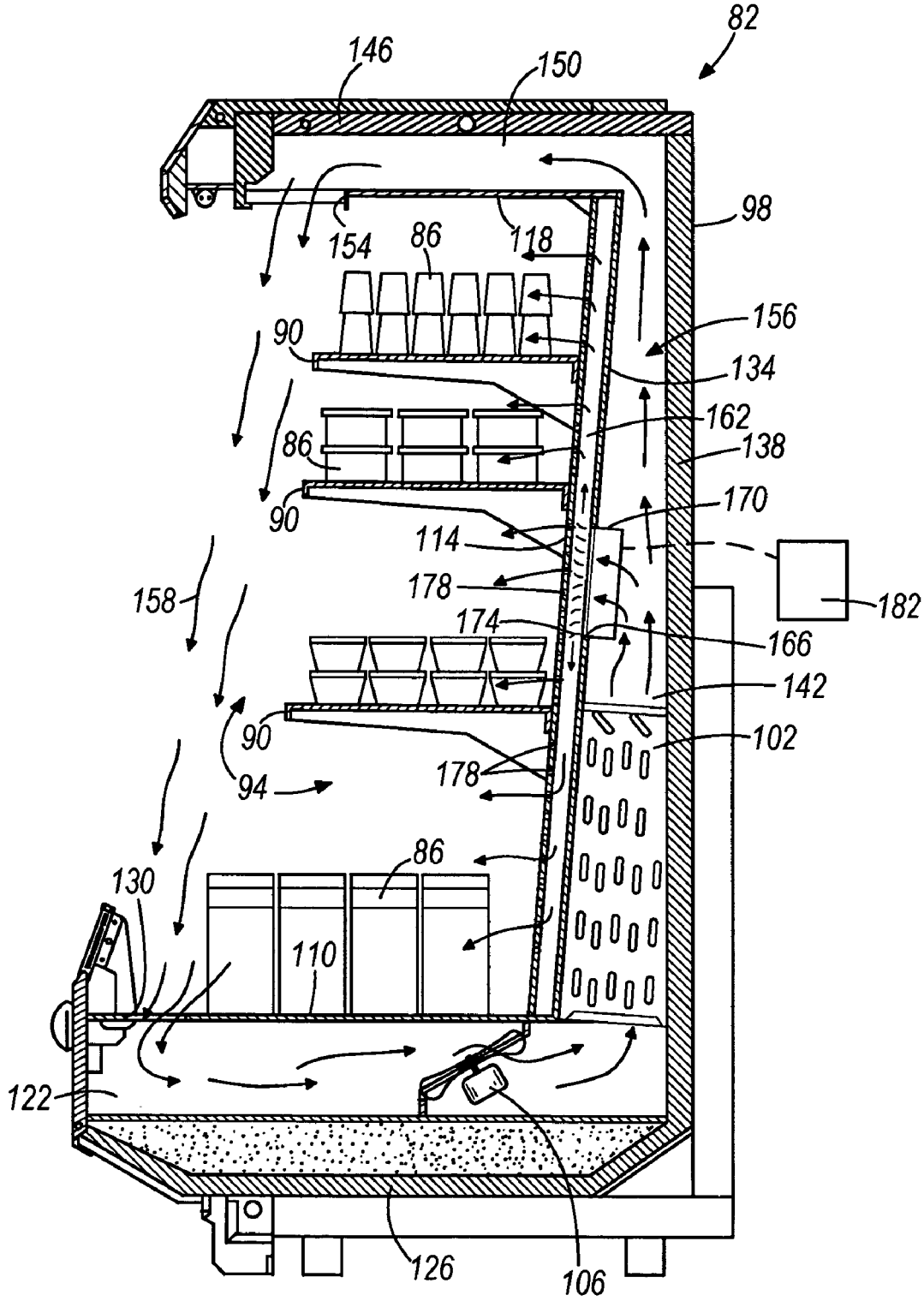
FIG. 2 is a cross-sectional view of a refrigerated merchandiser of the present invention, illustrating a fan pressurizing an air chamber in the merchandiser.

FIG. 2 illustrates a refrigerated merchandiser 82 of the present invention. The merchandiser 82 may contain a variety of products 86 situated on one or more shelves 90 in a product display area 94. The merchandiser 82 may comprise a low temperature merchandiser 82, in which the air temperature in the product display area 94 is maintained at a temperature below 32° F. Such low temperature merchandisers 82 may include, for example, frozen food merchandisers or ice cream merchandisers. Alternatively, the merchandiser 82 may comprise a medium temperature merchandiser 82, in which the air temperature in the product display area 94 is maintained within a standard temperature range of 32° F. to 41° F. Such medium temperature merchandisers 82 may include, for example, meat merchandisers, deli and dairy merchandisers, and produce merchandisers.

Figure 3:
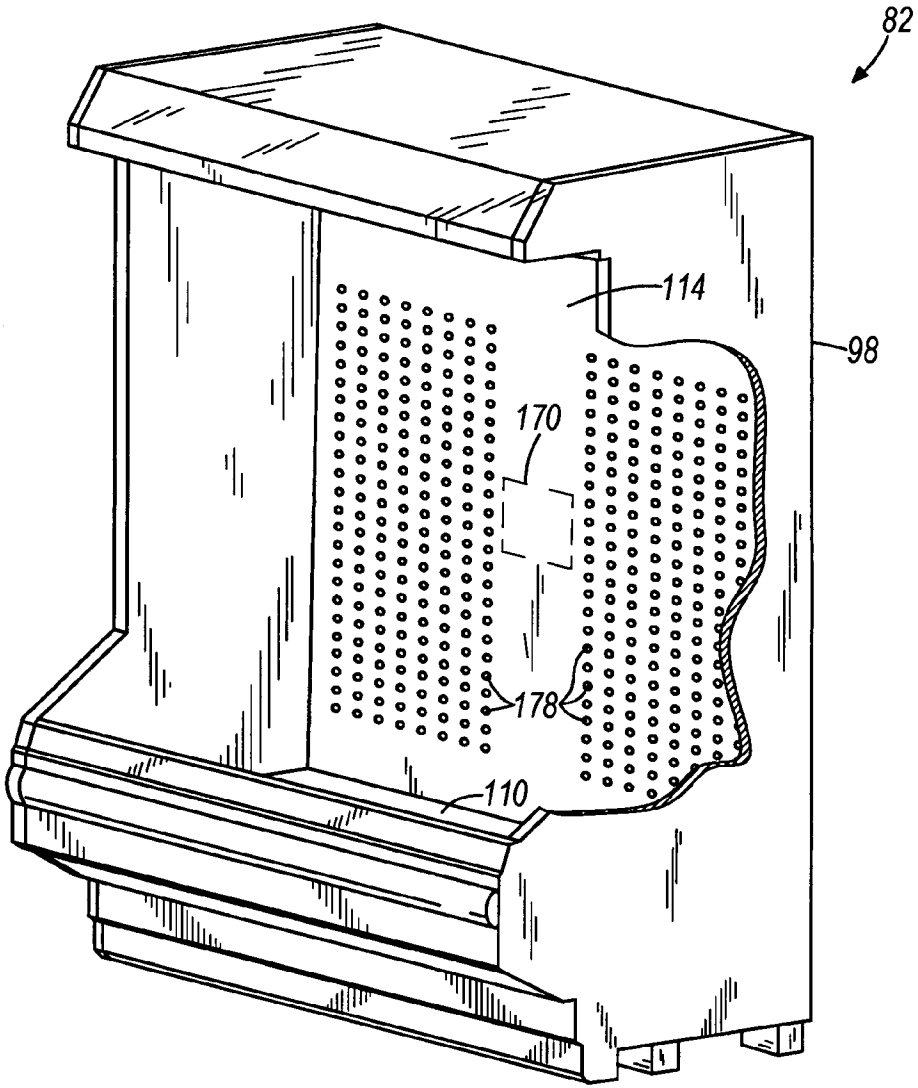
FIG. 3 is a front perspective view of the refrigerated merchandiser of FIG. 2.

With reference to FIG. 3, the merchandiser 82 may be comprised of one or more interconnected modules. Each module generally includes a case 98 having its own set of refrigeration components (e.g., an evaporator 102, an expansion valve, and one or more fans 106). The separate modules may be interconnected by decorative or structural moldings to give the appearance of a single merchandiser 82. In addition, the separate modules may be interconnected to give the appearance of a single product display area 94. For purposes of description only, a single merchandiser module will be described herein.

The merchandiser case 98 includes an interior bottom wall or shelf 110, an interior rear wall 114, and an interior top wall 118. The area bounded by the interior bottom shelf 110, interior rear wall 114, and the interior top wall 118 defines the product display area 94. The case 98 includes an open front face to allow customers access to the refrigerated products 86 stored in the case 98.

A lower flue 122 is generally defined between the interior bottom shelf 110 and an exterior bottom wall 126 of the case 98 to allow for substantially horizontal airflow throughout the lower flue 122 from the product display area 94. The interior bottom shelf 110 at least partially defines one or more openings 130 in the case 98 to allow communication between the product display area 94 and the lower flue 122 allowing air from the product display area 94 to be drawn into the lower flue 122.

The case 98 also includes another rear wall 134 adjacent to and spaced from the interior rear wall 114, and an exterior rear wall 138 adjacent to and spaced from the rear wall 134. A rear flue 142 is defined between the rear walls 134, 138, and is fluidly connected with and adjacent to the lower flue 122. The rear flue 142 allows for substantially vertical airflow throughout the rear flue 142.

The case 98 additionally includes an exterior top wall 146 adjacent the interior top wall 118. A top flue 150 is defined between the interior and exterior top walls 118, 146, and is fluidly connected with and adjacent to the rear flue 142. The top flue 150 allows for substantially horizontal airflow throughout the top flue 150. The interior top wall 118 includes one or more openings 154 to allow communication between the top flue 150 and the product display area 94 allowing airflow in the top flue 150 to be discharged from the top flue 150 into the product display area 94 as an air curtain 158. When combined, the lower flue 122, the rear flue 142, and the top flue 150 comprise an air passage 122, 142, 150 separate from the product display area 94. A portion of the air passage 122, 142, 150 containing or transporting the cooled or refrigerated air defines a cooling passage 156. In other words, as shown in FIG. 2, the cooling passage 156 is defined as that portion of the air passage 122, 142, 150 downstream of the evaporator 102, between the evaporator 102 and the opening 154. In alternate constructions, the merchandiser 82 may incorporate a plurality of air curtains 158 rather than a single air curtain 158.

The refrigerated merchandiser 82 also includes some components of a refrigeration system (not entirely shown) therein. The first or primary fan 106 is located within the lower flue 122 toward the back of the case 98 to generate an airflow through the air passage 122, 142, 150. The evaporator 102 is located within the rear flue 142 toward the bottom of the case 98. The evaporator 102 is positioned downstream of the primary fan 106 such that the airflow generated by the primary fan 106 passes through the evaporator 102 to be cooled. The resulting refrigerated airflow may then pass upwardly through the cooling passage 156 to be discharged into the product display area 94 to cool products 86 situated therein. Alternatively, the evaporator 102 may be positioned upstream of the primary fan 106 such that the primary fan 106 draws an airflow through the evaporator 102 for cooling.

As shown in FIG. 2, an air distribution chamber, or air chamber 162, is defined between the rear wall 134, or first wall, and the interior rear wall 114, or second wall. The rear wall 134 includes an aperture 166 therein to allow at least a portion of the refrigerated airflow in the cooling passage 156 to exit the cooling passage 156 and enter the air chamber 162. An auxiliary fan 170 is aligned with the aperture 166 in the rear wall 134 to draw the refrigerated airflow from the cooling passage 156 into the air chamber 162. Alternatively, each module comprising the merchandiser 82 may include more than one auxiliary fan 170 to draw the refrigerated airflow from the cooling passage 156 into the air chamber 162. The remaining portion of the refrigerated airflow not drawn into the air chamber 162 may continue upwardly through the cooling passage 156, then horizontally through the top flue 150 before being discharged as the air curtain 158.

In the illustrated construction, the auxiliary fan 170 is coupled to the rear wall 134 such that the auxiliary fan 170 is positioned in the rear flue 142. Alternatively, in another construction of the merchandiser 82, the auxiliary fan 170 may be positioned in the air chamber 162, or in yet another construction of the merchandiser 82, the auxiliary fan 170 may be positioned in the aperture 166 such that the auxiliary fan 170 occupies space in both the cooling passage 156 and the air chamber 162. The auxiliary fan 170 may be substantially similar to or different from the primary fan 106, and the primary and auxiliary fans 106, 170 may be configured to operate independently from each other. For example, the auxiliary fan 170 may be sized having a different (i.e., greater or lesser) flow capacity than the primary fan 106.

In the illustrated construction, a plurality of louvers 174 are positioned downstream of the auxiliary fan 170 such that the refrigerated airflow discharged by the auxiliary fan 170 is substantially distributed throughout the air chamber 162. In addition to guiding the airflow into the air chamber 162, the louvers 174 also regulate the amount of air that flows into the air chamber 162. The louvers 174 may be coupled to the rear wall 134 separate from the auxiliary fan 170, or the louvers 174 may be integral components of a housing 176 or cover of the auxiliary fan 170. Alternatively, other constructions of the merchandiser 82 may not utilize the louvers 174.

A plurality of perforations, outlet openings, or apertures 178 are defined in the interior rear wall 114 that fluidly connect the air chamber 162 and the product display area 94. The apertures 178 defined in the interior rear wall 114, in combination with the auxiliary fan 170, facilitate distribution of the refrigerated air from the air chamber 162 and into the product display area 94. In the illustrated merchandiser 82, the auxiliary fan 170 may pressurize the air chamber 162 to a static pressure between about 0.005 in $H_2O$ and about 0.05 in $H_2O$.

To achieve such a pressure in the air chamber 162, any of a number of different combinations of aperture size and airflow speed may be utilized. In the illustrated construction of the merchandiser 82, the apertures 178 may define a diameter of about ⅜", and the average speed of the refrigerated airflow discharged from the apertures 178 may be between about 200 feet/minute and about 700 feet/minute when the auxiliary fan 170 is activated. Preferably, the average speed of the refrigerated airflow discharged from the apertures 178 may be about 300 feet/minute. Alternatively, the average speed of the refrigerated airflow discharged from the apertures 178 may be between about 40 feet/minute and about 140 feet/minute when the auxiliary fan 170 is deactivated.

In a construction of the merchandiser 82 not utilizing the louvers 174, the average speed of the refrigerated airflow discharged from the apertures 178 may also be between about 200 feet/minute and about 700 feet/minute when the auxiliary fan 170 is activated. Preferably, the average speed of the refrigerated airflow discharged from the apertures 178 may be about 450 feet/minute. Alternatively, the average speed of the refrigerated airflow discharged from the apertures 178 may be between about 100 feet/minute and about 350 feet/minute when the auxiliary fan 170 is deactivated.

As shown in FIG. 3, the apertures 178 are distributed on the interior rear wall 114 such that a greater number of horizontal rows of apertures 178 exist than vertical columns of apertures 178. Also, the portion of the interior rear wall 114 directly facing the outlet of the auxiliary fan 170 does not have any horizontal rows of apertures 178 or vertical columns of apertures 178 passing therethrough. This may be done to facilitate the distribution of the refrigerated air throughout the air chamber 162.

In the illustrated merchandiser 82, each module includes 24 horizontal rows of apertures 178 and 16 vertical columns of apertures 178. The 16 vertical columns of apertures 178 are separated into two sections by the portion of the interior rear wall 114 not having any horizontal rows of apertures 178 or vertical columns of apertures 178 passing therethrough. Alternatively, merchandisers of different sizes may utilize a similar proportion of horizontal rows to vertical columns of apertures 178 (e.g., the 1.5:1 ratio of horizontal rows to vertical columns of apertures 178 in the illustrated merchandiser 82). Further, other merchandisers may utilize a larger or smaller ratio of horizontal rows to vertical columns of apertures 178 than the illustrated merchandiser 82.

The interior rear wall 114 may also include a discharge air opening (not shown) located adjacent the interior top panel 118. The discharge air opening may allow some of the refrigerated airflow in the cooling passage 156 to flow past the interior top panel 118 to sublimate frost accumulated on the surface of the interior top panel 118. The discharge air opening may be, for example, ⅛" wide and extend substantially across the length of the interior rear wall 114.

The pressurized and refrigerated airflow discharged from the air chamber 162 provides a positive equalized airflow to the products 86 situated in the product display area 94. Such a positive airflow, by sublimation, may decrease the amount of frost accumulated on the products 86 and/or the shelves 90 in the product display area 94. In other words, the increased rate of refrigerated airflow into the product display area 94 may increase the sublimation rate of frost from the products 86 and decrease the temperature of the products 86. In addition, since the pressurized and refrigerated airflow discharged from the air chamber 162 can be provided at an increased flow rate or an increased speed compared to the refrigerated airflow discharged by prior-art merchandisers 10, the temperature of the refrigerated airflow in the merchandiser 82 may be increased to achieve substantially the same refrigeration effect on the products 86 in the product display area 94 as in the prior-art merchandiser 10. As a result, the saturation temperature or operating temperature of the evaporator 102 may be increased, therefore reducing the energy consumption of the merchandiser 82.

Alternate constructions of the merchandiser 82 may comprise one or more apertures 166 in the rear wall 134, with one or more corresponding auxiliary fans 170 aligned with the respective apertures 166. Also, alternate constructions of the merchandiser 82 may comprise an air chamber 162 that does not extend the entire height and/or the entire width of the merchandiser 82. For example, the air chamber 162 may be sized such that it would discharge refrigerated air to only a specific portion of the product display area 94.

A controller 182 may be utilized with the merchandiser 82 to control operation of the primary fan 106, the auxiliary fan 170, or other refrigeration components in the merchandiser 82. The controller 182 is schematically shown in FIG. 2 to be electrically connected to the auxiliary fan 170, although the controller 182 may also be electrically connected to the primary fan 106 or other refrigeration components as previously stated.

During operation of the merchandiser 82, the controller 182 may be configured to cycle the merchandiser 82 through, for example, a normal refrigeration mode, in which compressed liquid refrigerant is allowed to expand and vaporize as it passes through the evaporator 102, and a defrost mode, in which gaseous refrigerant is passed through the evaporator 102 to substantially melt frost accumulated on the evaporator 102. In the normal refrigeration mode, the controller 182 may activate both the primary fan 106 and the auxiliary fan 170 to circulate the refrigerated airflow into the product display area 94. In the defrost mode, the controller 182 may deactivate the primary fan 106 and/or the auxiliary fan 170 to substantially prevent non-refrigerated or warm, moist air from being circulated into the product display area 94. This warm, moist air may otherwise cause unacceptable frost deposits in the product display area 94 of the low temperature merchandiser 82. In other words, deactivating the auxiliary fan 170 may substantially isolate the cooling passage 156 from the air chamber 162 and decrease the amount of frost that condenses on the products 86 during the defrost mode. When the merchandiser 82 returns to the normal refrigeration mode, the increased airflow through the product display area 94 substantially sublimes any moisture that collects on the products 86 during the defrost mode.

The controller 182 may also cycle the merchandiser 82 through other modes, such as an energy conservation mode, which may occur between two cycles of normal refrigeration mode. During such an energy conservation mode, all of the refrigeration components or a portion of the refrigeration components may be deactivated to conserve energy, including the primary fan 106 and/or the auxiliary fan 170.

The primary fan 106 and the auxiliary fan 170 may also be independently controlled from one another by the controller 182. For example, upon terminating a defrost cycle and beginning a normal refrigeration cycle, the primary fan 106 may be activated by the controller 182 before the auxiliary fan 170 to establish an airflow through the evaporator 102. The controller 182 may also control the speeds of either or both of the primary and auxiliary fans 106, 170. Rather than completely deactivating the fans 106, 170, the controller 182 may substantially decrease the speeds of the primary fan 106 and/or the auxiliary fan 170 such that the airflow generated by the fans 106 or 170 is less than that during the normal refrigeration mode.

Further, the controller 182 may interface with one or more sensors positioned throughout the merchandiser 82, such that the primary fan 106 and/or the auxiliary fan 170 may be activated or deactivated depending on the signals received from the one or more sensors.

I claim:

1. A refrigerated merchandiser, comprising:

a case defining a product display area;

an air passage at least partially surrounding the product display area, the air passage including a cooling passage directing refrigerated air to the product display area;

an air chamber separate from the cooling passage and in fluid communication between the cooling passage and the product display area;

a fan operable to draw the refrigerated air from the cooling passage and pressurize the refrigerated air within the air chamber to facilitate distribution of the refrigerated air from the air chamber and into product display area; and a plurality of louvers positioned downstream of the fan to guide the refrigerated air into the air chamber.

2. The refrigerated merchandiser of claim 1, wherein the fan is positioned in one of the cooling passage and the air chamber.

3. The refrigerated merchandiser of claim 1, further comprising a first wall separating the cooling passage from the air chamber, the first wall having an aperture fluidly connecting the cooling passage and the air chamber.

4. The refrigerated merchandiser of claim 3, further comprising a second wall spaced from the first wall, the second wall defining in combination with the first wall the air chamber.

5. The refrigerated merchandiser of claim 4, further comprising a plurality of apertures in the second wall fluidly connecting the air chamber and the product display area.

6. The refrigerated merchandiser of claim 1, wherein the refrigerated air is distributed to the product display area from the air chamber between about 200 feet/minute and about 700 feet/minute.

7. The refrigerated merchandiser of claim 1, wherein the cooling passage includes a substantially vertical portion, and wherein the fan draws the refrigerated air from the substantially vertical portion of the cooling passage.

8. The refrigerated merchandiser of claim 1, wherein the refrigerated air in the air chamber is pressurized to a static pressure of at least about 0.005 in H2O.

9. The refrigerated merchandiser of claim 1, further comprising a controller electrically connected with the fan, the controller operable to deactivate the fan during defrost mode of the merchandiser.

10. The refrigerated merchandiser of claim 1, wherein the pressurized refrigerated air in the air chamber provides a positive air flow over products positioned in the product display area to substantially sublimate frost accumulated on the products.

11. A refrigerated merchandiser, comprising:

a case defining a product display area;

a cooling passage at least partially defined in a rear portion of the case to direct refrigerated air to the product display area, the cooling passage defined in part by a first wall having an aperture therein and including a substantially vertical portion;

a second wall spaced from the first wall, the first and second walls defining in part an air chamber in fluid communication with the product display area through a plurality of apertures in the second wall; and a fan operable to move the refrigerated air from the substantially vertical portion and through the aperture in the first wall to pressurize the refrigerated air within the air chamber to facilitate distribution of the refrigerated air from the air chamber and into the product display area through the apertures in the second wall.

12. The refrigerated merchandiser of claim 11, wherein the fan is positioned in one of the cooling passage and the air chamber.

13. The refrigerated merchandiser of claim 11, wherein the refrigerated air is distributed to the product display area from the air chamber between about 200 feet/minute and about 700 feet/minute.

14. The refrigerated merchandiser of claim 11, further comprising a plurality of louvers positioned downstream of the fan to guide the refrigerated air into the air chamber.

15. The refrigerated merchandiser of claim 11, wherein the refrigerated air in the air chamber is pressurized to a static pressure of at least about 0.005 in H2O.

16. The refrigerated merchandiser of claim 11, further comprising a controller electrically connected with the fan, the controller operable to deactivate the fan during defrost mode of the merchandiser.

17. The refrigerated merchandiser of claim 11, wherein the pressurized refrigerated air in the air chamber provides a positive air flow over products positioned in the product display area to substantially sublimate frost accumulated on the products.

18. A refrigerated merchandiser, comprising:

a case defining a product display area and a cooling passage having a substantially vertical portion in a rear portion of the case separate from the product display area;

an evaporator operable to refrigerate airflow passing through the evaporator and into the substantially vertical portion;

a first fan operable to generate the airflow through the evaporator and into the substantially vertical portion;

a second fan positioned downstream of the evaporator to draw the refrigerated airflow from the substantially vertical portion; and an air distribution chamber adjacent to and in fluid communication with the substantially vertical portion to receive the refrigerated airflow drawn from the substantially vertical portion by the second fan, the air distribution chamber comprising a plurality of outlet openings fluidly communicating the air distribution chamber with the product display area to substantially distribute the refrigerated airflow to the product display area.

19. The refrigerated merchandiser of claim 18, wherein the second fan is positioned in one of the cooling passage and the air distribution chamber.

20. The refrigerated merchandiser of claim 18, further comprising a first wall separating the cooling passage from the air distribution chamber, the first wall having an aperture fluidly connecting the cooling passage and the air distribution chamber.

21. The refrigerated merchandiser of claim 20, further comprising a second wall spaced from the first wall, the second wall defining in combination with the first wall the air distribution chamber.

22. The refrigerated merchandiser of claim 21, wherein the outlet openings are located in the second wall.

23. The refrigerated merchandiser of claim 18, wherein the refrigerated airflow is distributed to the product display area from the air distribution chamber between about 200 feet/minute and about 700 feet/minute.

24. The refrigerated merchandiser of claim 18, further comprising a plurality of louvers positioned downstream of the second fan to guide the refrigerated air into the air distribution chamber.

25. The refrigerated merchandiser of claim 18, wherein the refrigerated airflow in the air distribution chamber is pressurized to a static pressure of at least about 0.005 in H2O.

26. The refrigerated merchandiser of claim 18, further comprising a controller electrically connected with the second fan, the controller operable to deactivate the second fan during defrost mode of the merchandiser.

27. The refrigerated merchandiser of claim 20, wherein the pressurized refrigerated airflow in the air distribution chamber provides a positive air flow over products positioned in the product display area to substantially sublimate frost accumulated on the products.

* * * * *